US008723671B2

(12) United States Patent
Foisy et al.

(10) Patent No.: US 8,723,671 B2
(45) Date of Patent: May 13, 2014

(54) ALARM MONITORING TELECOMMUNICATIONS LINE CONDITION DETECTION AND AUTOMATIC CALIBRATION

(75) Inventors: Stephane Foisy, Udora (CA); Pavel Raikhlin, Thornhill (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 247 days.

(21) Appl. No.: 13/145,700

(22) PCT Filed: Jan. 22, 2010

(86) PCT No.: PCT/CA2010/000090

§ 371 (c)(1),
(2), (4) Date: Jul. 21, 2011

(87) PCT Pub. No.: WO2010/083602

PCT Pub. Date: Jul. 29, 2010

(65) Prior Publication Data

US 2011/0298616 A1 Dec. 8, 2011

Related U.S. Application Data

(60) Provisional application No. 61/146,738, filed on Jan. 23, 2009.

(51) Int. Cl.
*G08B 21/00* (2006.01)

(52) U.S. Cl.
USPC ..... 340/540; 340/538.15; 340/7.1

(58) Field of Classification Search
USPC ..... 340/540, 628, 539.3, 539.31, 538.15, 340/538.12, 506–507, 511, 471, 571, 340/7.1–7.22
See application file for complete search history.

(56) References Cited

U.S. PATENT DOCUMENTS

| | | | | | |
|---|---|---|---|---|---|
| 4,456,788 | A | * | 6/1984 | Kline et al. | 379/137 |
| 4,751,724 | A | * | 6/1988 | Amadio et al. | 379/24 |
| 5,223,795 | A | * | 6/1993 | Blades | 324/536 |
| 5,422,626 | A | | 6/1995 | Fish | |
| 5,990,797 | A | * | 11/1999 | Zlotchenko et al. | 340/628 |
| 6,115,464 | A | | 9/2000 | Lester et al. | |

(Continued)

FOREIGN PATENT DOCUMENTS

| | | |
|---|---|---|
| EP | 0 570 097 A1 | 11/1993 |
| EP | 0 552 200 B1 | 8/2006 |

OTHER PUBLICATIONS

International Search Report issued May 13, 2010 for PCT Patent application No. PCT/CA2010/00090 filed Jan. 22, 2010.

(Continued)

*Primary Examiner* — Daniel Previl
(74) *Attorney, Agent, or Firm* — Smart & Biggar

(57) ABSTRACT

A method at an alarm monitoring station and security system arrangement for detecting alarm signals originating at security systems on incoming calls carried by a telecommunications line includes, for each call, measuring a noise level on the line in the absence of signals originated by the security systems. Based on the measuring, at least one signal detection threshold above the noise level is set, wherein a level of a signal must exceed the signal detection threshold in order to be detected as a data signal. Alarm data signals in the call are detected using the signal detection threshold.

24 Claims, 4 Drawing Sheets

(56) References Cited

U.S. PATENT DOCUMENTS

| | | | | |
|---|---|---|---|---|
| 7,424,097 | B2 * | 9/2008 | Shimura et al. | 379/1.04 |
| 2003/0162539 | A1 * | 8/2003 | Fiut et al. | 455/424 |
| 2004/0212494 | A1 | 10/2004 | Stilp | |
| 2006/0170541 | A1 | 8/2006 | Tompa et al. | |
| 2006/0182169 | A1 * | 8/2006 | Belge et al. | 375/222 |
| 2007/0161372 | A1 * | 7/2007 | Rogalski et al. | 455/426.1 |
| 2008/0132290 | A1 * | 6/2008 | Sharabi et al. | 455/567 |

OTHER PUBLICATIONS

Written Opinion issued May 13, 2010 for PCT Patent application No. PCT/CA2010/00090 filed Jan. 22, 2010.

European Patent Office, Supplementary European Search Report, dated Aug. 6, 2012, for European Patent Application No. 10733177.9, filed on Jan. 22, 2010 (7 Pgs.).

* cited by examiner

ALARM MONITORING TELECOMMUNICATIONS LINE CONDITION DETECTION AND AUTOMATIC CALIBRATION

CROSS-REFERENCE TO RELATED APPLICATIONS

This application is a national filing of International Application No. PCT/CA2010/000090 filed Jan. 22, 2010, entitled "ALARM MONITORING TELECOMMUNICATIONS LINE CONDITION DETECTION AND AUTOMATIC CALIBRATION", which claims benefits from U.S. Provisional Patent Application No. 61/146,738 filed Jan. 23, 2009, the contents of which are hereby incorporated herein by reference.

FIELD OF THE INVENTION

The present invention relates generally to security systems, and more particularly to testing line conditions of a telecommunications line for calls received by an alarm monitoring station.

BACKGROUND OF THE INVENTION

It is common for businesses and homeowners to have a security system for detecting alarm conditions at their premises and reporting these to a monitoring station. One of the primary functions of the monitoring station is to notify a human operator when one or more alarm conditions have been sensed by detectors installed at a monitored premise.

Detectors may vary from relatively simple hard-wired detectors, such as door or window contacts to more sophisticated battery operated ones such as motion and glass break detectors. The detectors may all report to an alarm control panel at the premises. The control panel is typically installed in a safe location and is connected to a power supply. The control panel is further in communication with the individual detectors to communicate with or receive signals from individual detectors. The communication between the alarm control panel and the detectors can be one or two way, and may be wired or wireless.

Upon being notified of a detected alarm condition, the control panel typically places a phone call to a monitoring station whose telephone number has been pre-programmed into the panel. At the monitoring station, the call is received by a complementary interface. Thereafter, the panel notifies the interface at the monitoring station using a protocol understood by both the panel and monitoring station.

It is widely recognized that noise, i.e. random fluctuation of electrical energy, is present on telecommunications lines (e.g. telephone lines). This noise may cause random and widely varying telephone line conditions from call to call. In particular, noise may even interfere with the monitoring station's ability to distinguish between noise and data signals (e.g. alarm data signals) on the line.

Various methods have been developed to handle noise in telephone calls between alarm panels and monitoring stations. One such method is to evaluate and record line conditions of telephone calls originating from a particular alarm panel. Upon receiving subsequent calls from the same alarm panel, certain settings at the monitoring station are adjusted in accordance with historically recorded noise levels in calls from that alarm panel.

Unfortunately, since noise is intrinsically random, it has proven difficult to develop a single rule to handle noise that works for all calls. Especially with the advent of VoIP (Voice over IP) services, even calls between the same two locations may have widely varying qualities per call.

Accordingly, there is a need for a method of adjusting signal detection thresholds at an alarm monitoring station, on a per call basis.

SUMMARY OF THE INVENTION

In a first aspect, there is provided a method of detecting alarm data signals originating at security systems on incoming calls carried by a telecommunications line at an alarm monitoring station. The method includes for each call, measuring a noise level on the line in the absence of signals originated by the security systems, and based on the measuring, setting at least one signal detection threshold above the noise level, wherein a level of a signal must exceed the signal detection threshold in order to be detected as a data signal. The method further includes detecting the alarm data signals in the call using the signal detection threshold.

In a second aspect, there is provided an alarm monitoring apparatus for receiving incoming alarm data signals on calls carried by a telecommunications line. The apparatus includes a noise detector, a signal detector and a controller in communication with the noise detector and the signal detector. The noise detector measures a noise level on the line in the absence of a data signal. The signal detector detects signals on the line, and has at least one adjustable signal detection threshold wherein a level of a signal must exceed the signal detection threshold in order to be detected as a data signal. The controller is operable to, for each of the incoming calls, receive an indication from the noise detector of a noise level on the line. Based on the indication, the controller is operable to set at least one signal detection threshold of the signal detector to exceed the noise level on the line, and detect the alarm data signals in each of the incoming calls using the signal detection threshold.

In a third aspect, there is provided a security system arrangement. The security system arrangement includes at least one telecommunications line, an alarm transmitter at a monitored premise for sending an alarm signal and an alarm monitoring station including an alarm monitoring apparatus. The apparatus includes a noise detector, a signal detector and a controller in communication with the noise detector and the signal detector. The noise detector measures a noise level on the line in the absence of a data signal. The signal detector detects signals on the line, and has at least one adjustable signal detection threshold wherein a level of a signal must exceed the signal detection threshold in order to be detected as a data signal. The controller is operable to, for each incoming call, receive an indication from the noise detector of a noise level on the line. Based on the indication, the controller is operable to set at least one signal detection threshold of the signal detector to exceed the noise level on the line, and detect the alarm data signals in each of the incoming calls using the signal detection threshold.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1:
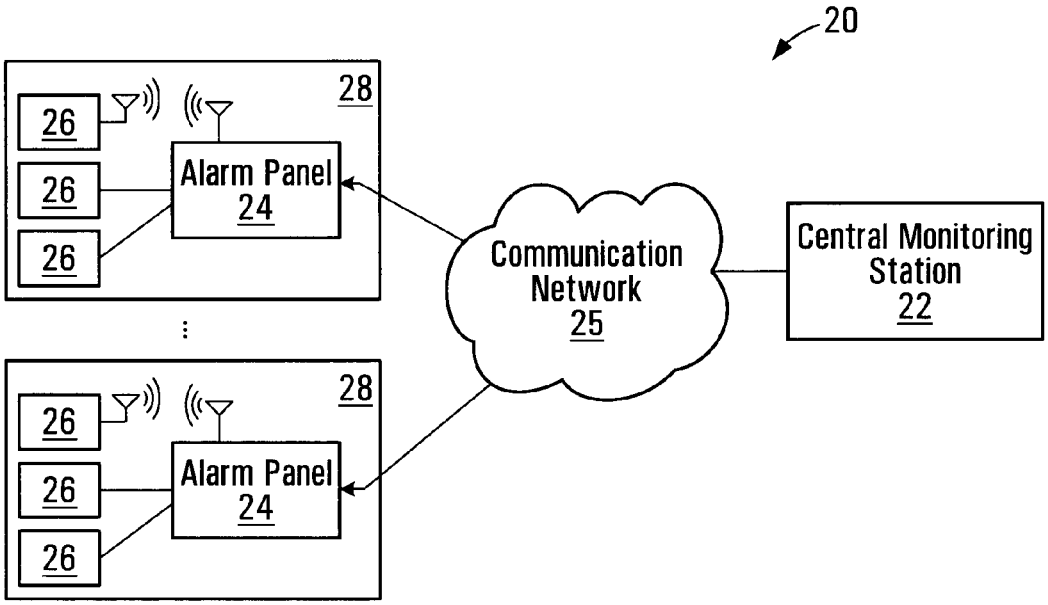
FIG. 1 is a schematic diagram of an alarm system, exemplary of an embodiment of the present invention.

FIG. 1 depicts an exemplary security system infrastructure 20 of security systems including multiple alarm panels 24 at customer premises, communicating through a network 25 such as the cellular telephone network or public switched telephone network (PSTN), with a central monitoring station 22.

Typically, alarm panels 24 are installed at residential or business premises 28 (hereinafter, individually monitored premise(s) 28). Each alarm panel 24 may be interconnected with one or more detectors 26. Each of detectors 26 provides information regarding the status of the monitored space to panel 24. Detectors 26 may include, for example, motion detectors, glass break detectors, and contact switches. Detectors 26 may be hard wired to alarm panel 24 or may communicate with alarm panel 24 wirelessly, in manners known to persons of ordinary skill in the art. Alarm panel 24 may further include other interfaces such as key pads, sirens, and the like, not specifically shown in FIG. 1.

A typical alarm panel 24 includes a processor; memory in communication with the processor, storing program instructions and configuration data for the processor/alarm panel 24; a detector interface for communication with detectors 26; and a network interface for communication with communication network 25. Example alarm panels include Digital Security Controls models PC1864 and PC9155.

Alarm panel 24 operates in a conventional manner. Program instructions stored in memory, along with configuration data may control overall operation of panel 24. In particular, a number of different PSTN telephone numbers may be stored in memory of alarm panel 24. These telephone numbers may include the telephone number of a central monitoring station (e.g. "416-555-1111" for central monitoring station 22), or alternate phone numbers by which central monitoring station 22 may be reached. Moreover, alarm panel 24 may be preprogrammed by an administrator of that panel to call a specific telephone number upon detection of a sensed event by one or more of detectors 26. For example, upon detecting a sensed event, alarm panel 24 may act as a transmitter, and place a call to central monitoring station 22 by calling "416-555-1111". In addition, alarm panel 24 may be programmed to call a telephone number by which a resident/administrator of the monitored premise may be reached (e.g. a cellular phone number of the homeowner, in the case where the monitored premise is a residential dwelling).

Once a telephone connection has been established by alarm panel 24 with central monitoring station 22, alarm panel 24 may send data representative of the sensed alarm event to central monitoring station 22. Specifically, alarm panel 24 may send the data using any one of a number of communication techniques. For example, the data may be sent to the monitoring centre as a series of dual-tone, multi frequency ("DTMF") tones using, for example, the SIA Protocol (as specified in the ANSI SIA DC-03-1990.01 Standard, the contents of which are hereby incorporated by reference), the ContactID Protocol, or as modulated data, modulated as pulses, or on a carrier frequency (generally, "alarm communication signal protocols").

Central monitoring station 22 is depicted as a single monitoring station in FIG. 1; however, it could alternatively be formed of multiple monitoring stations, each at a different physical location, and each in communication with communication network 25. As previously explained, central monitoring station 22 may be associated with a plurality of PSTN or cellular telephone numbers by which it can be contacted by alarm panels 24 to report alarm events over network 25. Thus, it will be apparent that central monitoring station 22 may receive many calls over network 25 potentially originating from many alarm panels 24.

Figure 2:
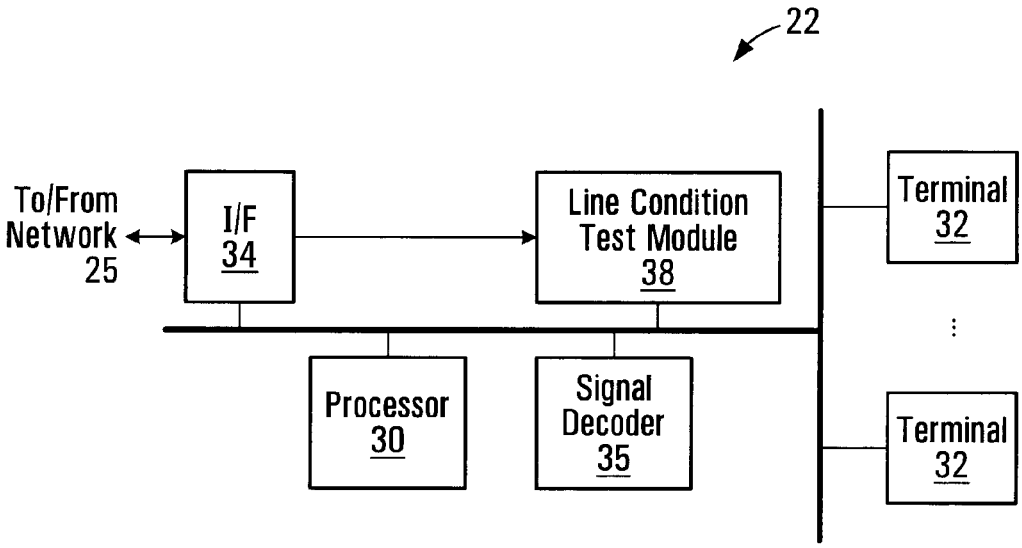
FIG. 2 is a schematic block diagram of a central monitoring station in the alarm system of FIG. 1.

FIG. 2 is a schematic block diagram of an exemplary central monitoring station 22. Specifically, monitoring station 22 may include receiver equipment available from Sur-Gard Security products, generally referred to as the Sur-Gard-System III, modified to function as described herein. As depicted in FIG. 2, central monitoring station 22 may include network interface 34, signal decoder 35, line condition test module 38, processor 30 and one or more terminals 32, exemplary of an embodiment of the present invention.

Processor 30 acts as a controller for central monitoring station 22, and is in communication with, and controls overall operation, of network interface 34, line condition test module 38, and terminal(s) 32. Processor 30 may include, or be in communication with, memory controlling the overall operation of monitoring station 22. Network interface 34 may be a conventional network interface that interfaces with communications network 25 to receive incoming signals. Signal decoder 35 may include a signal detector for detecting signals, and may further decode incoming signals to extract data therefrom (e.g. data relating to an alarm event). Terminal(s) 32 may be computers, or the like, to which received data representative of an alarm event is passed for handling by human operators.

Conventionally, central monitoring station 22 receives and processes incoming telephone that carry signals that may be representative of data ("data signals") that may be decoded. Data signals may for example take the form of amplitude modulated (AM) data, quadrature amplitude modulated data signals (QAM), frequency shift keyed signals (FSK), phase shift keyed signals (PSK), DTMF modulated data signals, components thereof, or the like. One or more data signals, in turn, may represent a bit, nibble, byte, or other data entity, indicative of an alarm condition, and may be combined and processed as alarm data signals at central monitoring station 22. Following establishment of a connection between alarm panel 24 and network interface 34, processor 30 may send a handshake signal to alarm panel 24 by way of network interface 34. In turn, alarm panel 24 may send back an expected reply signal. As will be understood by those skilled in the art, the handshaking typically involves the exchange of data between a sender, e.g. alarm panel 24, and a receiver, e.g. central monitoring station 22, to allow the sender and receiver to initiate connection and successfully further communicate. For example, data exchanged during a handshake may include an indicator of the signal protocol used by the sender to encode its outgoing data.

Following a successful handshake with a sending alarm panel 24, alarm panel 24 may begin transmitting data signals including alarm data signals representative of an alarm condition. Specifically, the incoming data signals may be input to signal decoder 35. Signal decoder 35 may decode the data signals to extract data. The extracted data may, for example, be overhead, or alarm data. The alarm data may be passed to processor 30, which, in turn, may make decisions based upon that data. In particular, processor 30 may be programmed to initiate certain alarm handling procedures based on the received data.

For example, alarm data extracted from one or more incoming alarm data signals may specify that a particular detector 26 at a particular monitored premise 28 was tripped. Processor 30 may be programmed to notify a human operator using the alarm data, for further action. Further action may include the human operator consulting, and calling, one of a list of phone numbers associated with that particular monitored premise. For example, the list may include the telephone number of the homeowner, and the operator may call the homeowner to determine what the problem was/is.

As should be apparent, the foregoing requires that the central monitoring station 22 is able to identify and process incoming signals as data signals. Specifically, telecommunications lines can be noisy—the noise may, for example, take the form of white noise, impulse noise and noise/interference from other sources. Also, decoding of data signals may be detrimentally affected by noise, and therefore, it is desirable that monitoring station 22 be able to handle a noisy line.

Accordingly, a receiver at central monitoring station 22, exemplary of embodiments of the present invention may better distinguish noise from data signals. In exemplary embodiments of the present invention, signals detected by central monitoring station 22 falling below a certain threshold, the "signal detection threshold", may be disregarded. Conversely, signal levels exceeding the signal detection threshold may be considered as data signals, and thus, a potential alarm data signal(s). Accordingly, and in accordance with an embodiment of the invention, upon connection by an alarm panel 24 with central monitoring station 22, the noise level on the telecommunications line connecting the two may be measured in the absence of signals originating from alarm panel 24, e.g. a noise level on the line is measured before alarm panel 24 begins transmitting any signals. Based on the measured noise level, a signal detection threshold may be set at monitoring station 22 for the call. Thereafter, any signals originating from alarm panel 24 that exceed the signal detection threshold are detected by monitoring station 22 as data signals (as opposed to noise). Signals and noise below the detection threshold may be ignored.

Figure 3:
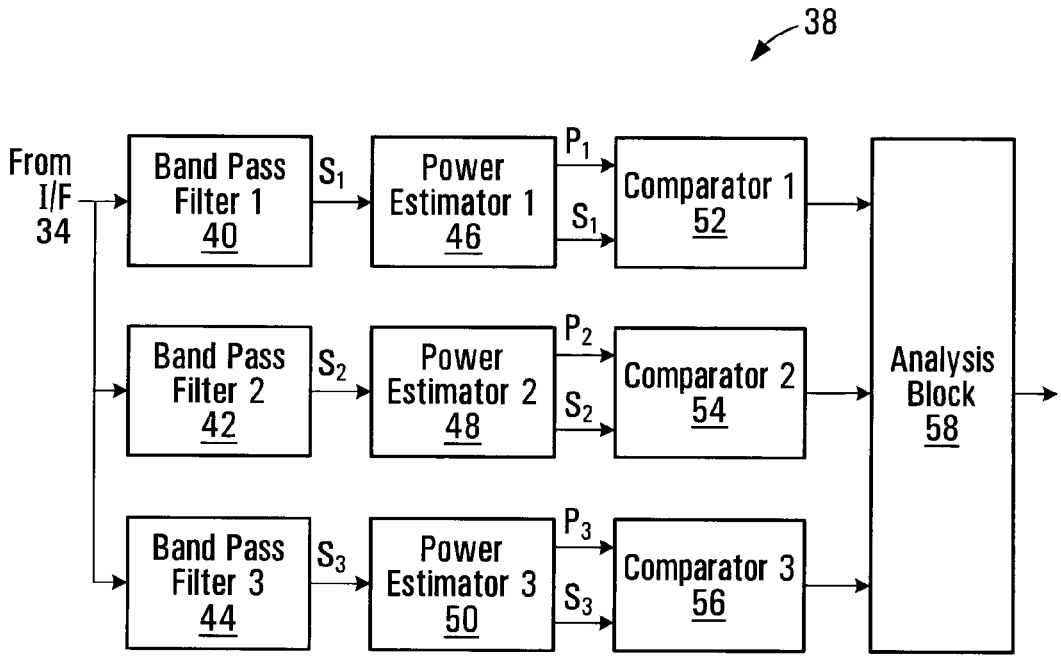
FIG. 3 is a block diagram depicting a line condition test module in the alarm system of FIG. 1, exemplary of an embodiment of the present invention.

FIG. 3 is a schematic diagram depicting components of line test condition module 38 that may be initiated upon connection by an alarm panel 24 with central monitoring station 22, before alarm panel 24 begins transmitting signals, to evaluate the condition, i.e., noise level, of the telephone line connecting alarm panel 24 with central monitoring station 22.

Line test condition module 38 may include a plurality (e.g. three) of groups of components connected in parallel. Each group may include a band pass filter, power estimator and comparator connected in series. The output of each of the three groups may be input into an analysis block, which may in turn, adjust the signal detection threshold(s), for example, of signal decoder 35, appropriately. Specifically line test condition module 38 may include band pass filter 1 40, power estimator 1 46, comparator 1 52, band pass filter 2 42, power estimator 2 48, comparator 2 54, band pass filter 3 44, power estimator 3 50 and comparator 3 56. Each of band pass filters 40, 42 and 44 may pass through signals in a respective frequency band of the telephony band ($B_1$, $B_2$ and $B_3$). The combined widths of each frequency band $B_1$, $B_2$ and $B_3$ may (but not necessarily) span the entire bandwidth of the telephony band, $B_{telephony}$, (i.e., $B_1+B_2+B_3=B_{telephony}$). For example the telephony band may encompass 0 to 3 kHz, and alarm signals may be found in the 300 Hz to 3 kHz band. Line test condition module 38 may be formed as part of a integrated circuit or the like, formed using conventional, electronic circuit design and fabrication techniques including integrated circuit design and fabrication techniques, large (or very large) scale integrated circuit design and fabrication techniques, application specific integrated circuit design and fabrication techniques, digital signal processor (DSP) design and fabrication techniques, or other circuit design and fabrication techniques for example analog design techniques or combinations of such techniques.

Following connection by alarm panel 24 with central monitoring station 22, and before sending any signals, central monitoring station 22 may activate line test condition module 38. Since at this time alarm panel 24 has not yet begun transmitting signals, only noise may be detected on the line, i.e. any signals detected on the line may be considered noise. The noise may be passed through band pass filters 40, 42 and 44 to produce filtered signals $S_1$, $S_2$ and $S_3$.

Filtered signals, $S_1$, $S_2$ and $S_3$, output from each of band pass filters 40, 42 and 44, respectively, may then be input into power estimators 46, 48 and 50 respectively. Power estimators 40, 42 and 44 may estimate and output values $P_1$, $P_2$ and $P_3$ indicative of the power of noise in $S_1$, $S_2$ and $S_3$ and thus frequency bands $B_1$, $B_2$ and $B_3$.

Power values $P_1$, $P_2$ and $P_3$ may be input into comparators 52, 54 and 56 respectively. Each of comparators 52, 54 and 56 may compare $P_1$, $P_2$ and $P_3$ to a signal detection threshold currently used by the signal detector of signal decoder 35 for each of frequency bands $B_1$, $B_2$ and $B_3$ (e.g. either a default threshold or the threshold set during a previous call). The currently used signal detection thresholds, as well as the highest tolerable signal detection thresholds may be stored within memory (or a register) accessible by comparators 52, 54 and 56, processor 30. The result of the comparisons, and the power values $P_1$, $P_2$ and $P_3$, may then be input into analysis block 58. Specifically, if the noise level $P_1$, $P_2$, or $P_3$ exceeds the currently used signal detection threshold, analysis block 58 may indicate to processor 30 that the signal detection threshold should be increased. Analysis block 58 may further send the power values $P_1$, $P_2$ and $P_3$ to processor 30 so that processor 30 may identify an appropriate signal threshold value, as further detailed below.

If processor 30 determines that power values $P_1$, $P_2$ and $P_3$ exceed the highest useable signal threshold(s) of detector/decoder 35, the call may be disconnected. In this case, processor 30 may terminate the connection with alarm panel 24 thereby prompting alarm panel 22 to establish another potentially less noisy re-connection between alarm panel 24 and central monitoring station 22. If an appropriate signal threshold of detector/decoder 35 is available, processor 30 may adjust the signal threshold and may then initiate sending of a handshake signal to sending alarm panel 24.

In an exemplary embodiment, each of comparators 52, 54 and 56 may measure the power of an input noise in a respective frequency band $B_1$, $B_2$ and $B_3$, and may output a representation of the measured power of any detected noise in $B_1$, $B_2$ and $B_3$ in dBms. Typically, data signals may be expected in the −20 to −10 dBm range in each frequency band. If the outputs of power estimators 46, 48 and 50 indicate that ambient noise is being detected in frequency band $B_1$ up to, for example, −15 dBm, then analysis block 58 in conjunction with processor 30 may direct signal decoder 35 to consider only signals exceeding −15 dBm in frequency band $B_1$ as data signals. That is, the signal detection threshold of signal decoder 35 in frequency band $B_1$ may be adjusted to a level exceeding noise level. Absent this adjustment, the data signal may have been improperly decoded by signal decoder 35, or signal decoder 35 may have erroneously treated, e.g., a −18 dBm signal, as a data signal.

The foregoing analysis may be similarly performed in each of the other two frequency bands, $B_2$ and $B_3$.

Figure 4A:
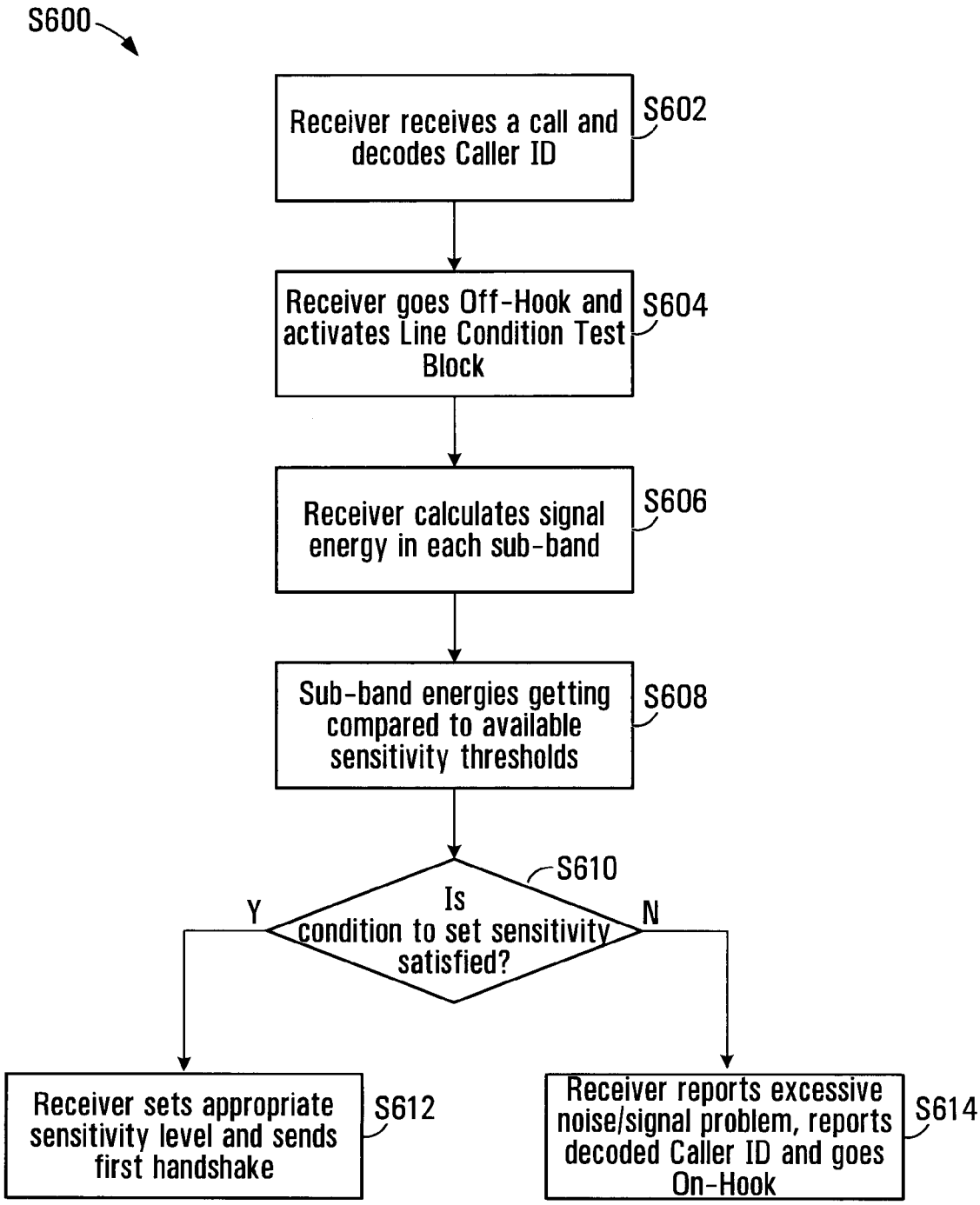
FIGS. 4A and 4B are flow diagrams depicting steps performed at the central monitoring station of FIG. 2, exemplary of an embodiment of the present invention.

In operation and as detailed in flow diagram S600 (FIG. 4A), upon receiving a call from alarm panel 24, central monitoring station 22 may optionally decode a caller ID/ANI of the calling alarm panel 24 (S602), using for example interface 34, to create a record that alarm panel 24 identified by that caller ID called. Central monitoring station 22 may go off-hook and activate line condition test module 38 (S604).

Line test condition module 38 may then calculate the signal power/energy in each respective frequency band of the telephony band, as detailed above (S606). The calculated signal power/energy may be compared to currently set signal detection thresholds in each respective frequency band of signal decoder 35 (S606). The result of the comparisons may be passed to analysis block 58 and thereon to processor 30. Alternatively, analysis block 58 may be formed as part of processor 30, or may be implemented in software and executed by processor 30.

A decision is made by processor 30 as to whether the calculated noise level exceeds a pre-defined maximum signal detection threshold in S610. For example, if data signals are expected in the −20 dBm to −10 dBm range, and the measured/calculated noise level exceeds −10 dBm, then data signals may be indistinguishable from noise. In such a case, processor 30 may instruct interface 34 to terminate the connection, i.e. go on-hook. Before or after terminating the connection, processor 30 may report/record excessive noise/signal problem from the caller ID/ANI associated with calling alarm panel 24 (S614).

Otherwise, processor 30 may set the signal detection threshold of signal decoder 35 to a value that equals or exceeds the measured/calculated noise power in each respective frequency band. Thereafter, processor 30 may initiate sending of a handshake signal to calling alarm panel 24 to thereby initiate transmission of data signals, including alarm data signals, by alarm panel 24 (S612).

Figure 4B:
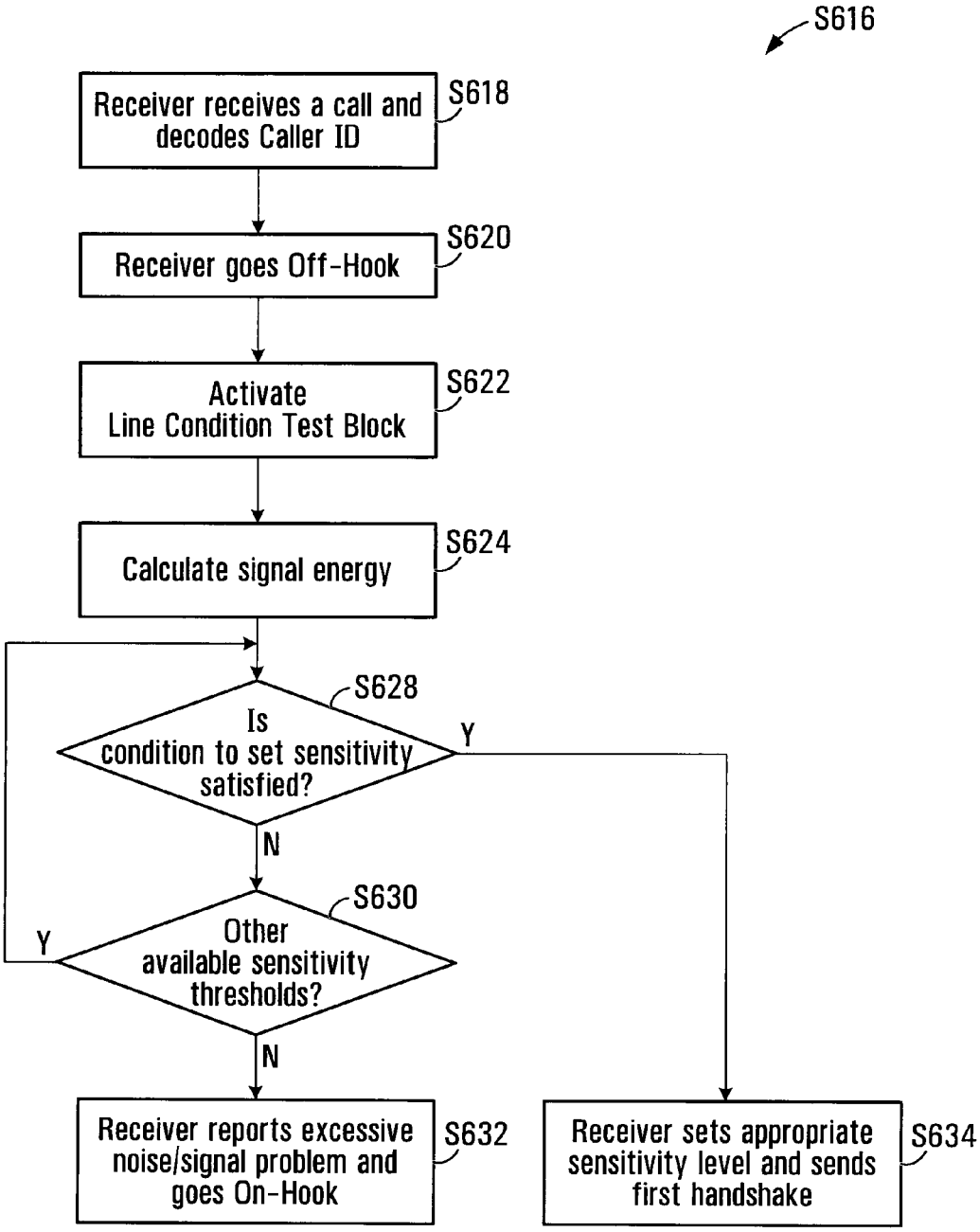

As previously discussed, signal decoder 35 may be operable using a range of available signal detection thresholds. The range of possible signal detection thresholds may be continuous, or discrete. In an alternate embodiment illustrated by flow diagram S616 (FIG. 4B), adjustment of the signal detection threshold among a number of discrete available signal detection thresholds of signal decoder 35 may be iterative. That is, in this embodiment, instead of comparing power values $P_1$, $P_2$ and $P_3$ to available or default signal detection thresholds of signal detector/decoder 35, the signal detection threshold may be iteratively adjusted by processor 30 as further detailed below. As in the first embodiment, the range of available signal detection thresholds and the initial/default threshold may be stored in a memory (or a register) accessible by processor 30 and signal detector/decoder 35.

Specifically, after receiving a call, going off-hook, activating line condition test module 38 and calculating the signal power/energy (S618, S620, S622, S624), the signal detection threshold of signal decoder 35 may be adjusted by processor 30 from an initial level (e.g. default level) within a range (e.g. −45 dBm to −15 dBm) where noise may be expected, for example, −40 dBm. processor 30. If any signal energy/power exceeding this initial/default threshold is present, signal decoder/detector 35 may send an indicator so indicating to processor 30. Processor 30 may read the next available discrete signal threshold (from memory or the register) and set the threshold of signal detector/decoder 35 to this next available threshold. Processor 30 may repeat this process until a signal threshold is identified above which no signal power/energy (i.e. noise) is present (S628-630). This iterative process may end when an appropriate threshold level is found (S634).

For example, if the signal detection threshold is initially set to −45 dBm and noise is present at or above this level, then this may indicate that the threshold level is set too low. Thus, the threshold level may be adjusted to the next available signal threshold level (up to, for example, −20 dBm). If noise still exceeds this level, then the signal threshold level would still be set too low. Accordingly, processor 30 may iteratively choose a possible signal detection threshold level for use by signal detector/decoder 35 for which no noise is present at or above that threshold. If no such signal detection threshold level within the signal detection range of signal detector/decoder 35 can be found by processor 30, processor 30 may send an instruction to interface 34 to drop the call. Moreover, processor 30 may report/log excessive noise/signal problem from the caller ID/ANI associated with the calling alarm panel (S632).

Conveniently, the signal threshold level set during the process of flow diagrams S600 and S616 may be logged by processor 30. Thereafter, for calls originating from the same caller ID/ANI, processor 30 may set an initial level for the signal detection threshold for signal decoder 35 at the logged value. This may speed up the line conditioning process for subsequent calls from that caller ID/ANI. In particular, by beginning the iterative process (S616) at the signal detection threshold set during the last/previous call(s) from that caller ID/ANI, threshold levels that were tried but rejected during those previous calls may not be tried again. Also conveniently, a historical record of the logged values for a given caller ID/ANI may be analyzed to determine if call quality of calls originating from a given caller ID/ANI is improving or deteriorating.

Thus, as should now be apparent, the above-described method allows central monitoring station 22 to adjust signal detection threshold(s) of signal decoder 35 on a per call basis, in accordance with measured noise levels present in the telephone line for each call. Moreover, since central monitoring station 22 may also keep a record of call qualities for each caller ID/ANI, a consistent change in call quality (or patterns in call qualities) from a particular caller ID/ANI may be identified. For example, a consistent change in call quality from a particular caller ID/ANI that persists over time may be indicative of a change of telecommunications line provider at that monitored premise. However, identified changes in call quality that are seemingly random from a particular caller ID/ANI may be flagged to an operator for investigation/follow-up.

While signal power is represented in dBm in the above described embodiment, other measures of signal power/energy that provide a way of distinguishing between noise and expected data signals may be known to those of ordinary skill in the art and should therefore be considered to be within the scope of the invention.

In another embodiment, line condition test module 38 may be implemented in software (e.g. running on processor 30), rather than as digital signal processor(s). Similarly, any component depicted in FIG. 2 may be implemented in software or as a combination of software and hardware.

In yet another embodiment, line test condition module 38 may be activated both before and after handshake (in the time interval between data signals) to account for and adjust for fluctuations in line quality during a call.

In yet another embodiment, processor 30 may keep a record of signal detection threshold levels set in all calls. An analysis may be performed to identify instructive patterns. For example, if all calls (i.e. calls regardless of originating caller ID/ANI) exhibit a high noise level, this may be indicative of problems in the receiver equipment at central monitoring station 22, thus prompting examination of the equipment at central monitoring station 22. Similarly, records of signal detection threshold levels set during calls decoded by each signal decoder 35 may be kept, thereby possibly revealing problems with a particular signal decoder.

In yet another embodiment, an initial signal threshold level for a particular caller ID/ANI may be identified during a "test" phase initiated by an installer during installation of an alarm system.

In yet another embodiment, the signal threshold level may be set in accordance with the signal modulation technique used to modulate the expected data signals from a particular caller ID/ANI. For example, if central monitoring station 22 is expecting DTMF signals from a particular caller ID/ANI, for calls from that caller ID/ANI, line test condition module 38 may detect noise that may specifically interfere with or prevent detection of DTMF signals. In contrast, if central monitoring station 22 is expecting FSK signals from a particular caller ID/ANI, for calls from that caller ID/ANI, line test condition module 38 may specifically detect noise that may interfere with or prevent detection of FSK signals.

Of course, the above described embodiments are intended to be illustrative only and in no way limiting. The described embodiments of carrying out the invention, are susceptible to many modifications of form, arrangement of parts, details and order of operation. The invention, rather, is intended to encompass all such modification within its scope, as defined by the claims.

What is claimed is:

1. A method of detecting alarm data signals originating at security systems on incoming calls received by way of a telecommunications line at an alarm monitoring station, said method comprising:

for each call, measuring a noise level in at least one frequency band on said telecommunications line in the absence of signals originated by said security systems in said at least one frequency band;

based on said measuring, setting at least one signal detection threshold above said noise level, wherein a level of a signal must exceed said signal detection threshold in order to be detected as a data signal; and detecting said alarm data signals in said call using said signal detection threshold.

2. The method of claim 1 wherein said measuring comprises measuring noise on said telecommunications line following establishment of a call between a security system and said alarm monitoring station and prior to transmission of alarm data signals by said security system.

3. The method of claim 1 wherein said measuring comprises measuring a noise level in each of at least two frequency bands, and said setting comprises setting at least two signal detection thresholds above said noise level, one corresponding to each of said at least two frequency bands, wherein a level of a signal in each of said frequency bands must exceed a corresponding one said signal detection threshold in order to be detected as a data signal.

4. The method of claim 3 wherein said detecting said alarm data signals comprises detecting data signals in each of said at least two bands.

5. The method of claim 3 wherein said detecting said alarm data signals comprises detecting data signals in each of said at least two bands, concurrently.

6. The method of claim 1 further comprising after said setting, initiating transmission of said data signals.

7. The method of claim 6 wherein said alarm data signals encode alarm event data generated by an alarm event at a premise monitored by a security system and said initiating comprises sending a handshake signal to said security system.

8. The method of claim 1 further comprising for each said call, extracting an identifier of a security system originating said call.

9. The method of claim 1 further comprising relating said identifier to said signal detection threshold and logging said relation in a log.

10. The method of claim 1 wherein said setting comprises setting an initial signal detection threshold and adjusting said initial signal threshold until a signal detection threshold above noise level is identified.

11. The method of claim 10 wherein said initial signal detection threshold for a call from a given originating security system is based on at least one signal detection threshold set in previous calls from said given originating security system.

12. An alarm monitoring apparatus for receiving incoming alarm data signals on calls carried by a telecommunications line, said apparatus comprising:

a noise detector for measuring a noise level on said telecommunications line in the absence of a signal in said at least one frequency band originated by said alarm transmitter;

a signal detector for detecting signals on said telecommunications line, said signal detector having at least one adjustable signal detection threshold wherein a level of a signal must exceed said signal detection threshold in order to be detected as a data signal; and a controller in communication with said noise detector and said signal detector, said controller operable to, for each of said calls:

receive an indication from said noise detector of a noise level in said at least one frequency band on said telecommunications line;

based on said indication, set at least one signal detection threshold of said signal detector to exceed the noise level on said telecommunications line; and detect said alarm data signals in each said incoming calls using said signal detection threshold.

13. The apparatus of claim 12 wherein said at least one signal detection threshold comprises a set of available signal detection thresholds and wherein said controller is further operable to: based on said indication, select a particular signal detection threshold from said set.

14. The apparatus of claim 12 wherein said noise detector and said signal detector comprise a component for measuring signal power.

15. The apparatus of claim 12 wherein said noise detector measures noise levels in each of at least two frequency bands.

16. The apparatus of claim 15 wherein said controller is further operable to:

receive an indication from said noise detector of a noise level in at least two frequency bands; and set at least two signal detection thresholds above said noise level, one corresponding to each of said at least two frequency bands, wherein a level of a signal in each of said frequency bands must exceed a corresponding one said signal detection threshold in order to be detected as a data signal.

17. The apparatus of claim 16 wherein said controller is further operable to:

decode alarm data signals detected by said signal detector in each of said at least two bands.

18. The apparatus of claim 12 further comprising a transmitter for transmitting a handshake signal to initiate receipt of a data signal following setting of said at least one signal detection threshold.

19. A security system arrangement comprising:

at least one telecommunications line;

an alarm transmitter at a monitored premise for sending an alarm signal;

an alarm monitoring station comprising an alarm monitoring apparatus, said apparatus comprising:

a noise detector for measuring a noise level on said telecommunications line in the absence of a signal in at least one frequency band originated by said alarm transmitter;

a signal detector for detecting signals on said telecommunications line, said signal detector having at least one adjustable signal detection threshold wherein a level of a signal must exceed said signal detection threshold in order to be detected as a data signal; and a controller in communication with said noise detector and said signal detector, said controller operable to, for each incoming call:

receive an indication from said noise detector of a noise level in said at least one frequency band on said telecommunications line;

based on said indication, set at least one signal detection threshold of said signal detector to exceed the noise level on said telecommunications line; and detect said alarm data signals in each said incoming call using said signal detection threshold.

20. The security system arrangement of claim 19 wherein said at least one signal detection threshold comprises a set of available signal detection thresholds and wherein said controller is further operable to:

based on said indication, select a particular signal detection threshold from said set.

21. The security system arrangement of claim 19 wherein said noise detector and said signal detector comprise a component for measuring signal power.

22. The security system arrangement of claim 19 wherein said noise detector measures noise levels in each of at least two frequency bands.

23. The security system arrangement of claim 22 wherein said controller is further operable to:

receive an indication from said noise detector of a noise level in at least two frequency bands; and set at least two signal detection thresholds above said noise level, one corresponding to each of said at least two frequency bands, wherein a level of a signal in each of said frequency bands must exceed a corresponding one said signal detection threshold in order to be detected as a data signal.

24. The security system arrangement of, claim 23 wherein said controller is further operable to:

detect alarm data signals in each of said at least two bands.

* * * * *